US012319475B2

(12) United States Patent
Rubino, Jr.

(10) Patent No.: US 12,319,475 B2
(45) Date of Patent: Jun. 3, 2025

(54) CAP FOR A TATTOO BOTTLE WITH SECURE LID

(71) Applicant: Ink Projects LLC, Fort Mill, SC (US)

(72) Inventor: Louis Rubino, Jr., York, SC (US)

(73) Assignee: INK PROJECTS LLC, Fort Mill, SC (US)

( * ) Notice: Subject to any disclaimer, the term of this patent is extended or adjusted under 35 U.S.C. 154(b) by 0 days.

(21) Appl. No.: 17/354,635

(22) Filed: Jun. 22, 2021

(65) Prior Publication Data

US 2021/0331841 A1 Oct. 28, 2021

Related U.S. Application Data

(63) Continuation of application No. 16/207,409, filed on Dec. 3, 2018, now Pat. No. 11,066,215.

(51) Int. Cl.
*B65D 47/08* (2006.01)

(52) U.S. Cl.
CPC ..... *B65D 47/0838* (2013.01)

(58) Field of Classification Search
CPC ..... B65D 47/08; B65D 47/0804; B65D 47/0809; B65D 47/0814; B65D 47/0823; B65D 47/0828; B65D 47/0833; B65D 47/0838; B65D 47/0842; B65D 47/0847; B65D 47/0852; B65D 47/0857; B65D 47/0861; B65D 47/0866; B65D 47/0871; B65D 47/0876; B65D 47/0888; B65D 47/0885; B65D 47/089; B65D 47/0895
See application file for complete search history.

(56) References Cited

U.S. PATENT DOCUMENTS

| | | | |
|---|---|---|---|
| 3,107,035 | A | 10/1963 | Betram |
| D350,482 | S | 9/1994 | Hu |
| 5,603,436 | A | 2/1997 | Leoncavallo |
| 5,996,859 | A | 12/1999 | Beck |
| 6,269,986 | B1 | 8/2001 | Gross |
| D447,949 | S | 9/2001 | Richardson |
| 6,505,530 | B2 | 1/2003 | Adler et al. |
| 6,543,650 | B1 | 4/2003 | Sprick |
| 6,685,719 | B2 | 2/2004 | Matera, Jr. |
| D531,900 | S | 11/2006 | Mavin |
| 7,281,638 | B2 | 10/2007 | Hierzer |
| D672,237 | S | 12/2012 | Simonian |
| D672,253 | S | 12/2012 | Lee |
| D673,043 | S | 12/2012 | Antier |
| 8,413,832 | B2 | 4/2013 | Mazurkiewcz |
| 8,459,452 | B1 | 6/2013 | Barth |
| D702,545 | S | 4/2014 | Barth |
| 8,851,290 | B2 | 10/2014 | Barth |
| 8,985,366 | B2 | 3/2015 | Barth |
| D732,975 | S | 6/2015 | Hua |

(Continued)

FOREIGN PATENT DOCUMENTS

WO 2017013226 A1 1/2017

OTHER PUBLICATIONS

World Famous Tattoo Ink, YouTUbe, "Jay Freestyle Ink Set", https://www.youtube.com/watch?v=TTqDnCjpa38 (Published Apr. 20, 2017).

*Primary Examiner* — Andrew T Kirsch
(74) *Attorney, Agent, or Firm* — Volpe Koenig

(57) ABSTRACT

A tattoo ink bottle is provided having an openable sanitary cap that is configured for one-handed operation and a tight closed seal.

21 Claims, 4 Drawing Sheets

(56) References Cited

U.S. PATENT DOCUMENTS

| | | | | |
|---|---|---|---|---|
| 9,051,090 | B2 | 6/2015 | Antier | |
| 9,169,048 | B2 | 10/2015 | Ludewigs et al. | |
| D763,078 | S | 8/2016 | Roy | |
| 9,439,523 | B2 | 9/2016 | Naesje et al. | |
| D770,287 | S | 11/2016 | Holaschke | |
| D780,578 | S | 3/2017 | Lane et al. | |
| 9,850,044 | B2 | 12/2017 | Muhlemann | |
| D817,169 | S | 5/2018 | Dzikowicz et al. | |
| D836,441 | S | 12/2018 | Huang | |
| D837,650 | S | 1/2019 | Rognard | |
| D854,414 | S | 7/2019 | Michaolodes | |
| 10,442,591 | B2 | 10/2019 | Rognard | |
| D895,438 | S | 9/2020 | Heiser | |
| D904,884 | S | 12/2020 | Wohlgenannt | |
| D928,629 | S | 8/2021 | Yang | |
| 2004/0069806 | A1* | 4/2004 | Benoit-Gonin | B65D 47/0838 222/153.06 |
| 2005/0279727 | A1 | 12/2005 | Grasswald | |
| 2005/0279781 | A1 | 12/2005 | Pugne | |
| 2006/0016776 | A1 | 1/2006 | Barre | |
| 2007/0102390 | A1 | 5/2007 | Hoepner | |
| 2007/0175910 | A1 | 8/2007 | Hogarth | |
| 2008/0011704 | A1 | 1/2008 | Van Ryn | |
| 2008/0169261 | A1 | 7/2008 | Druitt | |
| 2009/0120899 | A1 | 5/2009 | Stull | |
| 2009/0152269 | A1 | 6/2009 | Pucci | |
| 2009/0308832 | A1 | 12/2009 | Von Spreckelsen | |
| 2011/0000928 | A1* | 1/2011 | Antier | B65D 55/024 220/801 |
| 2011/0100990 | A1 | 5/2011 | Clodfelter | |
| 2011/0163135 | A1 | 7/2011 | Herald et al. | |
| 2012/0000079 | A1 | 1/2012 | Ametoli | |
| 2012/0067922 | A1 | 3/2012 | Benoit-Gonin | |
| 2014/0034663 | A1 | 2/2014 | Konigseder et al. | |
| 2014/0097150 | A1 | 4/2014 | Antier | |
| 2016/0311589 | A1 | 10/2016 | Wochelle | |
| 2017/0334631 | A1 | 11/2017 | Veltri | |
| 2018/0265238 | A1 | 9/2018 | Wilson | |

* cited by examiner

CAP FOR A TATTOO BOTTLE WITH SECURE LID

CROSS REFERENCE TO RELATED APPLICATION

This application is a continuation of U.S. application Ser. No. 16/207,409 filed Dec. 3, 2018, the entire contents of which is incorporated by reference as if fully set forth herein.

FIELD OF THE INVENTION

This invention relates to the field of tattoo ink bottles, and more particularly, to a tattoo ink bottle having a cap with an improved closure seal and one-handed operation.

BACKGROUND

Tattoos are a widely popular as a form of personal and artistic expression. Because the tattooing process involves injecting ink into the dermis layer of the skin using several inks and/or colors over a long period of time, there are attendant risks of infection. Some sources of infection are from a bottle of tattoo ink, whether incorporated by the manufacturer in the manufacturing or filling or later during transport of the bottle. Other sources of infection relate to use of the bottle by the tattoo artist during dispensing, re-use, or dilution of the ink. Accordingly, it is important for a tattoo ink bottle to provide a secure seal to prevent contamination.

At the same time, for the tattoo artist, tattooing is a time-consuming, delicate procedure that requires focus on both the artistic work and hygienic procedures. Several tattoo ink bottles may need to be opened and closed several times while the artist also manages needles, lighting, a stencil, and other nearby objects. It is advantageous if a tattoo ink bottle can be opened consistently with one hand.

Thus, there is the need for a tattoo bottle that improves both hygienic and ergonomic performance by providing a strong closure seal while still being relatively easy to open one-handed.

SUMMARY

The present invention provides for a cap including a base, a hinge, and a lid. The base has a nozzle with a rim. The lid has first and second operative regions and inner and outer sealing parts for engaging the rim. The first operative region is defined by a first recessed face and a ledge, and the second operative region is defined by a second recessed face and a portion of the hinge. The lid is connected to the base by the hinge. The lid is openable by pressing the first operative region in a first direction and closeable by pressing the second operative region in a second direction.

In another embodiment, the present invention is directed to a bottle including a bottle body and a removable cap. The removable cap has a base, a lid, and a hinge. The lid includes diametrically-opposed first and second operative regions defined by respective first and second recessed faces. The hinge connects the base and the lid, and is located in the second operative region. The cap is openable by pressing the first operative region in an upward direction and closeable by pressing the hinge in a radially inward direction.

In yet another embodiment, the lid is openable by pressing each of the first and second operative regions in respective directions either simultaneously or sequentially.

DETAILED DESCRIPTION

Figure 1:
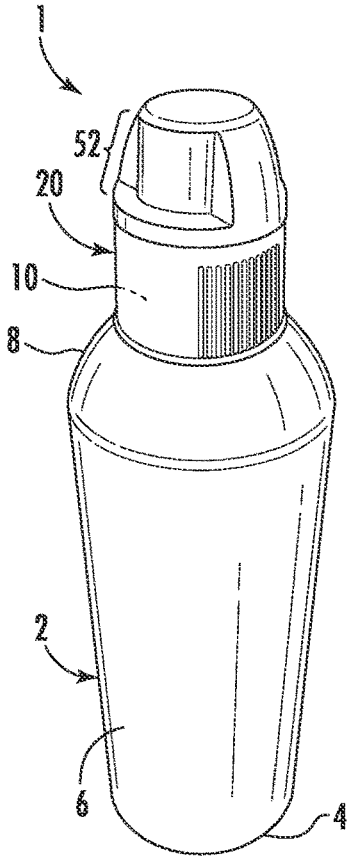
FIG. 1 is a front perspective view of an exemplary tattoo ink bottle according to an embodiment of the present application, including a cap.

Certain terminology is used in the following description for convenience only and is not considered limiting. Words such as "front", "back", "top" and "bottom" designate directions in the drawings to which reference is made. This terminology includes the words specifically noted above, derivatives thereof and similar words. Additionally, the terms "a" and "one" are defined as including one or more of the referenced item unless specifically noted. The phrase "at least one" followed by a list of two or more items (such as A, B, or C) means any individual one of A, B or C as well as any combination thereof. The term "substantially" means within ±5% of a given value or ±5 degrees from a given angle, as appropriate. The terms "about" and "generally" mean within ±10% of a given value, as appropriate.

At the outset, it is understood that this invention is not limited only to the particular embodiments, methodology, materials, and modifications described herein, and as such may vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the following example methods, devices, and materials are now described.

Figure 2:
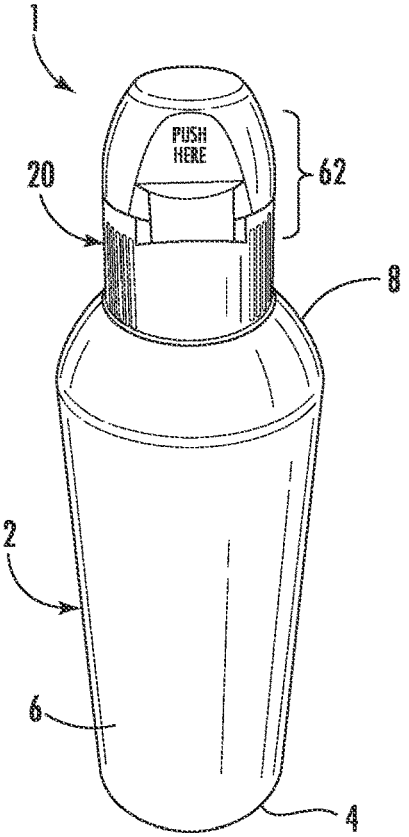
FIG. 2 is a rear perspective view of the bottle of FIG. 1.
Figure 3:
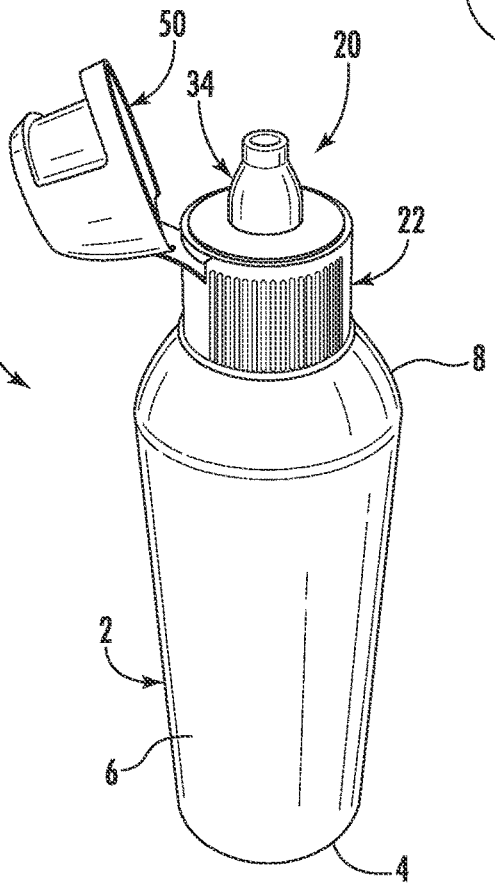
FIG. 3 is a side perspective view of the bottle of FIG. 1 with the cap in an open position.
Figure 4:
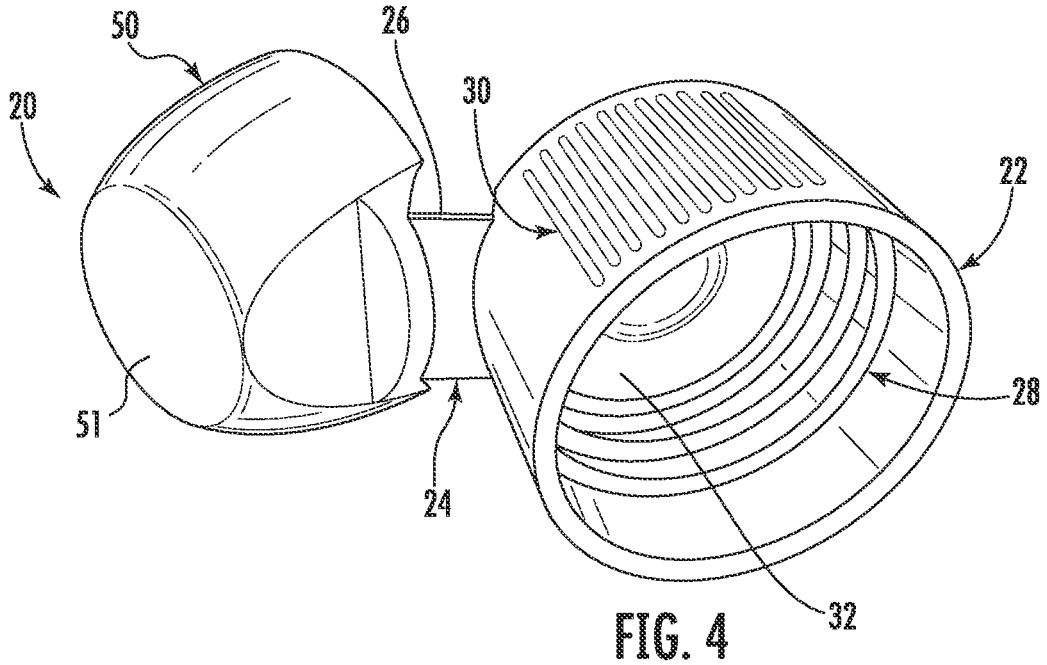
FIG. 4 is a bottom view of the cap of the bottle of FIG. 1 in an open position.

FIGS. 1-3 show an exemplary embodiment of a tattoo ink bottle 1 including a body 2 and a cap 20. The body 2 includes a bottom 4, sidewall 6, tapered neck 8, and a top portion 10 for receiving the cap 20. The top portion is preferably externally threaded to mate with internal threads 28 of the cap 20 as shown in FIG. 4 and as discussed further below. The illustrated body 2 is generally cylindrical, although various other shapes are contemplated.

FIGS. 4-9 show the cap 20 of the exemplary embodiment. The cap 20 includes a base 22 and a lid 50 connected by a hinge 24. The hinge 24 is illustrated as a living hinge 26 integrally formed with the cap 20 and produced by the same manufacturing process at the same time. One of skill in the art will recognize that the hinge 24 may alternatively be a piano hinge, a living hinge, a pivot mechanism, a pinned door/gate hinge, or the like.

The base 22 of the cap 20 includes internal threads 28 for removable attachment to the top portion 10 of the body 2 of the tattoo ink bottle 1. A tactile feature 30, illustrated as a series of elongated indentations, is provided externally to aid in twisting the cap 20 on or off of the body 2, and may also be used to aid in the process of opening the lid 50 as discussed further below. One of skill in the art will recognize that various ergonomic features may serve as the tactile feature 30, such as elongated raised portions, a roughened surface texture, or the like.

Figure 8:
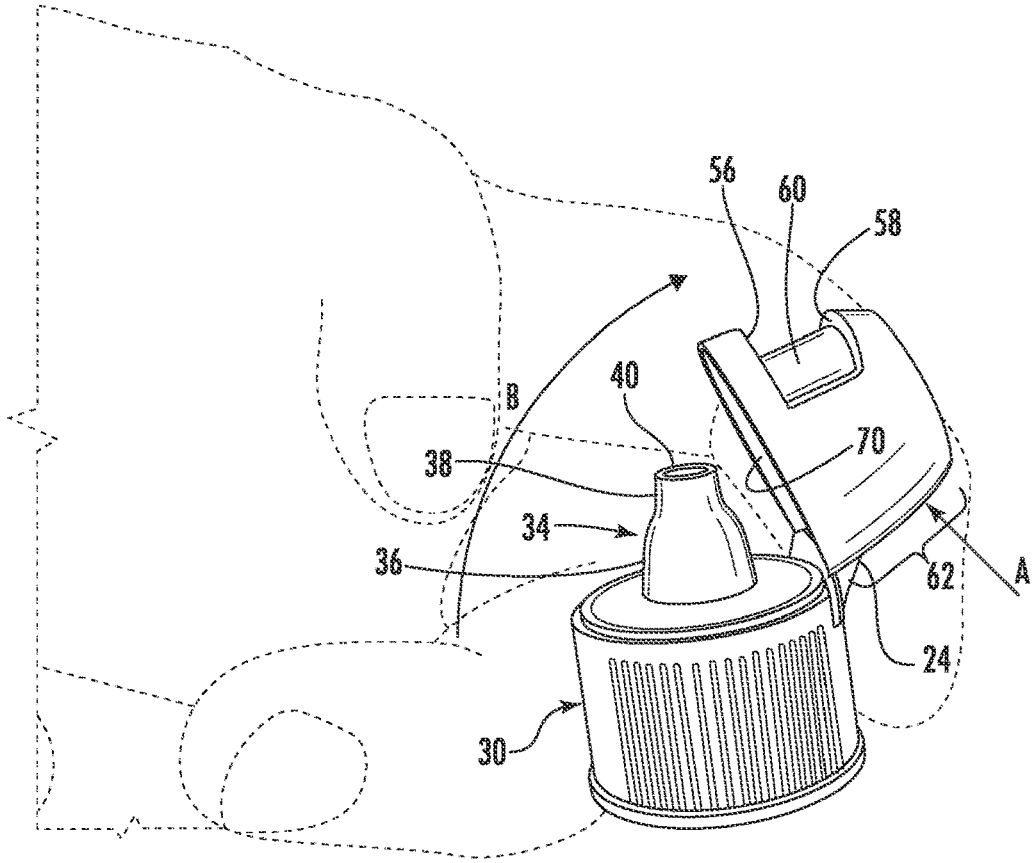
FIG. 8 is a side view of the cap of FIG. 4 in the open position.
Figure 9:
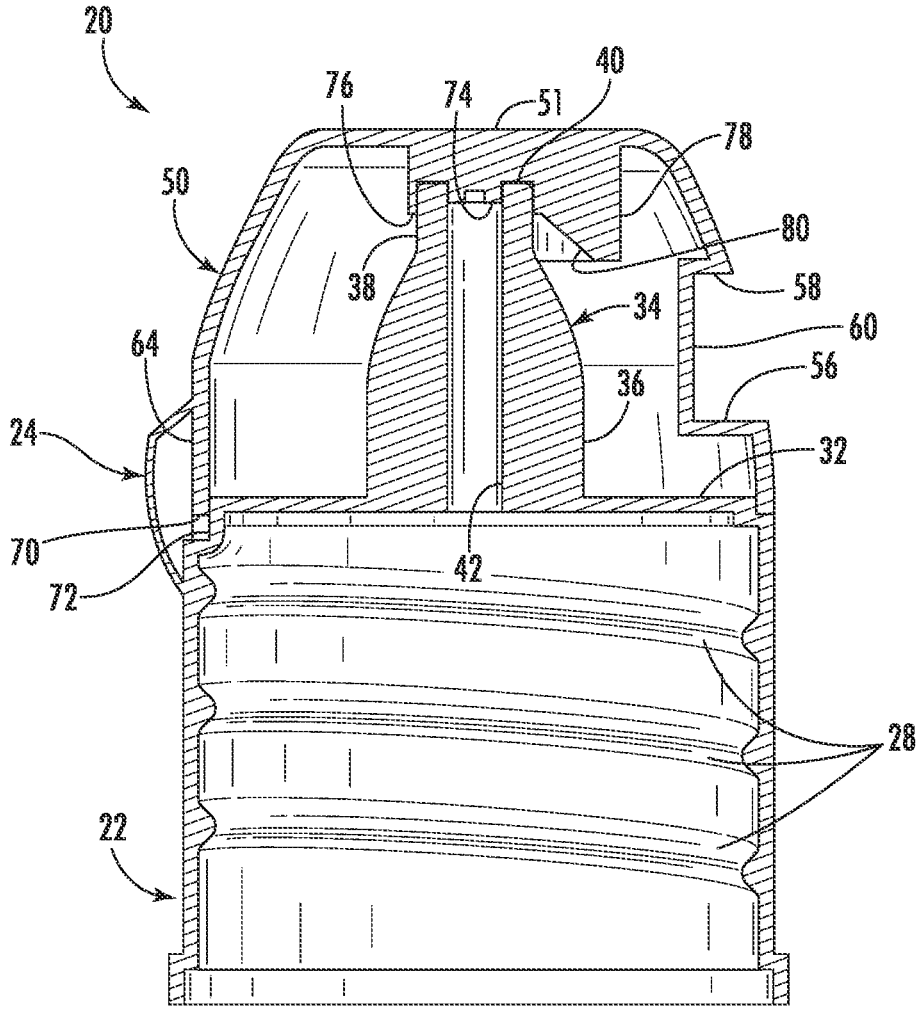
FIG. 9 is a cross-sectional side view of the cap of FIG. 4, taken along the line I-I of FIG. 5.

The base 22 of the cap 20 also includes a shoulder 32 connecting to a nozzle 34 for dispensing ink. The shoulder 32 and the nozzle 34 can be integrally formed as one piece that is separable from the base 22, or they can be integrally formed with the base 22. As best shown in FIGS. 8-9, the nozzle 34 includes a lower portion 36 and an upper portion 38 terminating at a rim 40, with a passage 42 extending through the nozzle 34. The lower portion 36 may be tapered and the upper portion 38 may be cylindrical.

Figure 5:
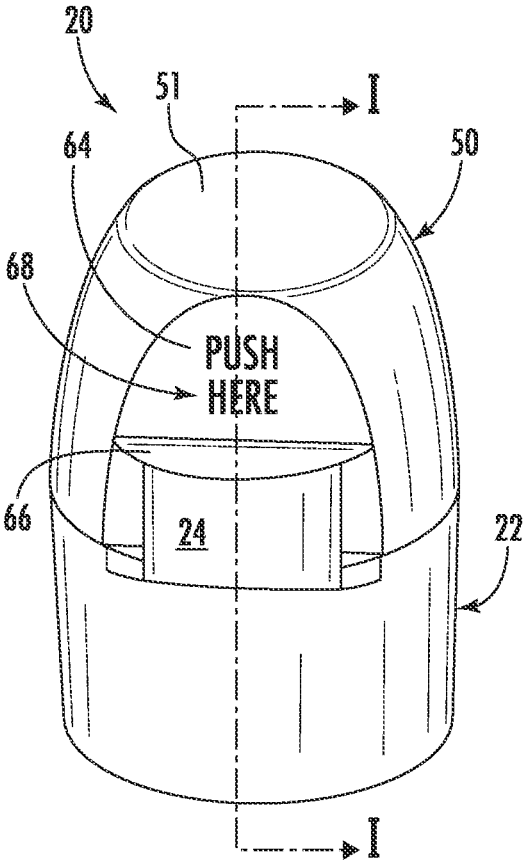
FIG. 5 is a rear perspective view of the cap of FIG. 4 in the closed position.

The lid 50 of the cap 20, shown in detail in FIGS. 4-9, includes a variety of features for improved ergonomics to open and close the lid, particularly to open or close the lid with only one hand. A top 51 of the lid 50 may be substantially flat. A first operative region 52 is provided on the front of the lid 50 opposite the hinge 24. The first operative region 52 includes a recess 54 defined by a lower ledge 56, upper ledge 58, and a first recessed face 60. As shown in FIG. 9, the lower ledge 56 and the upper ledge 58 may be substantially parallel, with both the upper and lower ledge substantially perpendicular to the first recessed face 60. A second operative region 62 is provide on the rear of the lid 50 and includes a second recessed face 64 and the hinge 24 connected by a central ledge 66. The first operative region 52 and the second operative region 62 are circumferentially spaced apart by about 180 degrees; in other words, they are positioned on diametrically opposed sides of the cap 20. The central ledge is flexible and in use can pivot relative to the hinge 24 and/or relative to the second recessed face 64. As shown in FIG. 5, the second recessed face 64 may include indicia 68 such as "PUSH HERE" or other relevant instructions to aid a user in opening and/or closing the cap 20.

The first recessed face 60 and the second recessed face 64 are recessed in the radial direction of the cap 20. The first recessed face 60 and the second recessed face 64 may have various shapes, such as substantially planar, convexly curved concentrically with a bottom rim 70 of the lid 50, or concavely curved as shown with the second recessed face 64 in FIG. 6.

Figure 6:
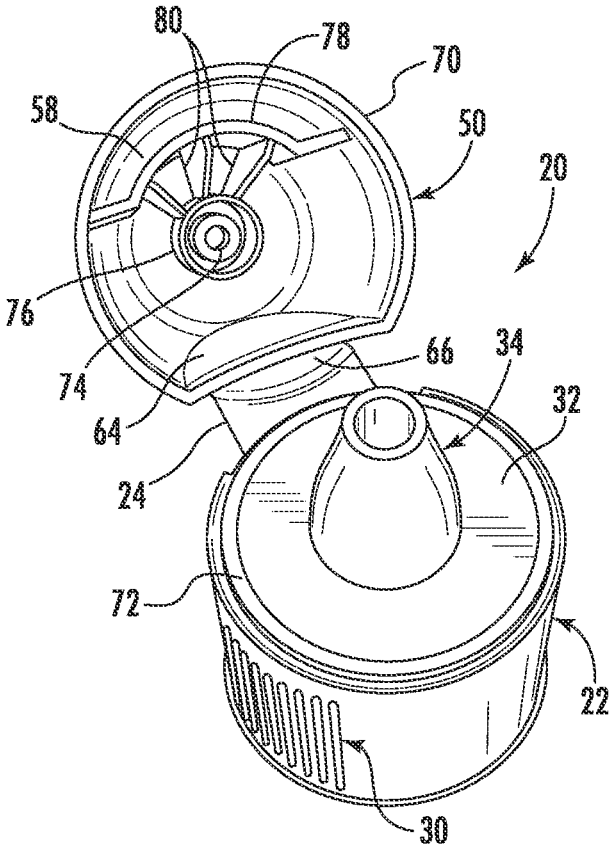
FIG. 6 is a top perspective view of the cap of FIG. 4 in the open position.

The lid 50 also includes several features to ensure tight engagement with the base 22. As shown in FIGS. 6, 8, and 9, the lower rim 70 of the lid 50 is designed to tightly engage an upper rim 72 of the base 22. An inner sealing part 74 and an outer sealing part 76 are concentrically circular and extend down from the top 51 of the lid to engage the rim 40 of the nozzle 34. As discussed below, the inner and outer sealing parts 74, 76 may have a tight fit with the rim 40. A beam 78 extends up from the upper ledge 58 to the top 51. As shown in FIG. 6, the beam 78 may include outer chordal sections and an inner circumferential section. One or more radial ribs 80 may extend between the outer sealing part 76 and the beam 78, preferably at the inner circumferential section of the beam. In this manner, the beam 78 and the ribs 80 provide structural reinforcement to the upper ledge 58, the outer sealing part 76, and the top 51.

Figure 7:
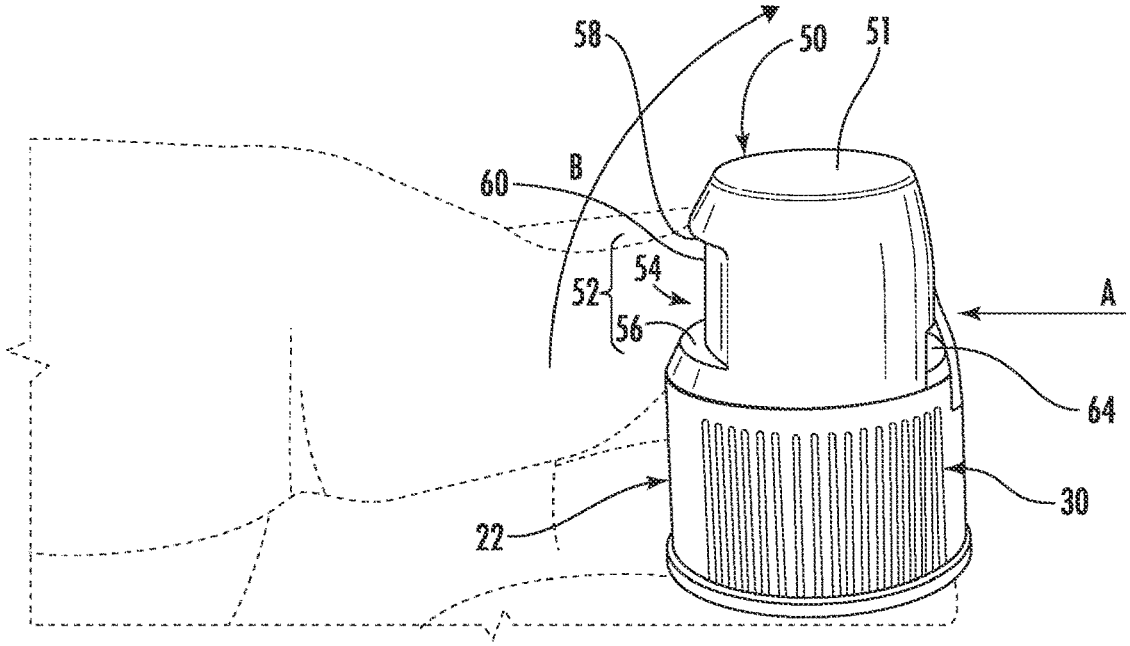
FIG. 7 is a side view of the cap of FIG. 4 in the closed position.

One embodiment of a method for opening and closing the cap 20 is shown in FIGS. 7 and 8. To open the lid 50, a user may press the first operative region 52, particularly the upper ledge 58 and the first recessed face 60, upward as indicated with the arrow B. One skilled in the art would appreciate that the recess 54 of the first operative region 52 ergonomically allows a user to gain purchase and traction on the lid 50 with a single finger for then pressing in the direction B. In an alternative embodiment, a user may press a finger in the second operative region 62 radially inward as indicated with the arrow A. This pressing in the direction A may be directly against the hinge 24, promoting deformation of the lid 50 to allow the lid 50 to be easily separated from the base 22 prior to or simultaneously with pressing the first operative region 52.

The pressing in the directions A and B may generally be considered two operative motions or actions. The pressing in the directions A and B may be done separately, or when opening the lid 50 may be done simultaneously or sequentially in any order.

To close the cap 20, a user presses the lid 50 inward at the second operative region 62 in the direction A and/or down onto the top 51. An audible "click" or other audible feedback may be provided to confirm to a user that the cap 20 is fully closed. This feedback is caused by the close fit and tolerances of the interfitted parts, including at least one of inner and outer sealing parts 74, 76 snapping onto the nozzle 34. Because the closing motion may require a relatively high degree of force, the beam 78 and the ribs 80 advantageously support the structure of the lid 50 and prevent any deformation of the material, particularly preventing deformation of the top 51 or the inner and outer sealing parts 74, 76.

One of skill in the art would recognize that various changes to the structure or operation of the tattoo ink bottle 1 are within the scope of the present application. For example, in a reversed position of FIGS. 7 and 8, pressing in direction A could be performed by a user's thumb while pressing in direction B is performed by the user's finger. In another embodiment, both pressing motions may cooperatively aid in causing the lid 50 to release from the base 22 of the cap 20. In this case, pressing in direction B may deform the circumference of the lid 20 to separate it from the base 22 or pressing in direction B may urge the hinge 24 radially inward to cause an upward motion of the lid 50. Performing both pressing motions together can increase the overall separating force applied. As such, there may be a relatively high holding strength of the lid 50 on the base 22 that may nonetheless be overcome by this two-stage one-handed operation.

The arrangement of the present invention, having tightly interfitted parts and two operative actions, provides advantages over the prior art. The cap 20 provides an improved seal for the bottle 2, preventing contamination or accidental spilling of the ink contents. This improved seal does not sacrifice utility due to the ergonomic two operative actions. At the same time, the structural arrangement and reinforcement of the cap 20 promote both of these advantages.

The first and second recessed faces 60, 64 provide ergonomic benefits in quickly and smoothly operating the cap 20. The upper and lower ledges 56, 58 also improve ergonomics and strength of the lid 50.

Accordingly, various suitable materials may be employed in constructing the bottle 2 and the cap 20, including various plastic or polymeric materials, metals or metal alloys, glass, and the like. Plastics are particularly applicable for providing strength with a slight degree of plasticity or elasticity to allow for close tolerances of the interfitting parts discussed above. The relative thickness of different parts may vary; for example, structural parts such as the beam 78 and ribs 80 may be relatively thicker than the inner and outer sealing parts 74 and 76 that may have some "give" to fit around the nozzle 34. The entire cap 20 may be integrally formed as one molded plastic part formed in the same process at the same time, or may be made of multiple parts assembled together.

It is understood that this invention is not limited to the particular embodiments disclosed, but is intended to cover all modifications and combinations which are within the spirit and scope of the invention as described herein and/or defined by the appended claims, the above description, and/or shown in the attached drawings. One skilled in the art will appreciate that various changes are possible.

What is claimed is:

1. A cap comprising:

a base comprising a portion configured to attach to and surround an opening of a bottle, wherein the base further comprises a shoulder formed at an upper end of the base, and a nozzle extends from the shoulder, wherein the nozzle has a frusto-conical lower portion;

a lid configured to be positioned above the base, the lid having a top that is substantially flat, the lid including:

a first operative region defined by a first recessed curved wall surface having a boounded perimeter defined by a first longitudinal wall, a second longitudinal wall, an upper ledge, and a lower ledge, the first operative region positioned at a first side of the lid, wherein the lid is configured to be openable by pressing the first operative region in a first direction; and a hinge, the hinge extending between the lid and the base and attaching the lid to the base, a first end of the hinge connected to the lid and a second end of the hinge connected to the base;

wherein the shoulder is positioned below the first operative region, and wherein the frusto-conical lower portion of the nozzle has a first end connected to the shoulder at an area positioned below the first operative region, wherein, in the area where the first end of the frusto-conical lower portion of the nozzle is connected to the shoulder, the shoulder is substantially flat and parallel to the top of the lid, and wherein the shoulder is formed as a substantially flat wall extending circumferentially inwardly from adjacent an upper rim of the base, and wherein at least a portion of the shoulder adjacent the hinge extends directly beneath and substantially parallel to at least a portion of the top of the lid when the lid is in a closed position.

2. The cap according to claim 1, wherein the upper ledge extends between an upper portion of the first longitudinal wall and an upper portion of the second longitudinal wall, and the lower ledge extends between a lower portion of the first longitudinal wall and a lower portion of the second longitudinal wall.

3. The cap according to claim 1, wherein a lower surface of the upper ledge faces an upper surface of the lower ledge.

4. The cap according to claim 1, wherein the first longitudinal wall, the second longitudinal wall, the upper ledge, and the lower ledge are each defined by uninterrupted wall surfaces.

5. The cap according to claim 1, wherein the lower ledge is spaced apart from an annular bottom rim of the lid in an axial direction.

6. The cap according to claim 1, wherein the first recessed curved wall surface is recessed inward relative to the upper ledge and the lower ledge.

7. The cap according to claim 1, wherein the first recessed curved wall surface is continuous between the first longitudinal wall, the second longitudinal wall, the upper ledge, and the lower ledge.

8. The cap according to claim 1, wherein a depth of the lower ledge is greater than a depth of the upper ledge.

9. The cap according to claim 1, wherein the first recessed curved wall surface consists of a sealed wall.

10. The cap according to claim 1, further comprising a second operative region defined by a recessed face, the second operative region positioned on a side of the lid opposite the first operative region, the second operative region being substantially planar.

11. The cap according to claim 10, wherein the first end of the hinge connects to the lid adjacent a ledge formed at a base of the second operative region.

12. The cap according to claim 10, wherein the first recessed curved wall surface curves away from the second operative region.

13. The cap according to claim 1, wherein the shoulder is substantially flat.

14. A cap comprising:

a base comprising a portion configured to attach to and surround an opening of a bottle, wherein the base further comprises a shoulder formed at an upper end of the base, and a nozzle extends from the shoulder, wherein the nozzle has a frusto-conical lower portion;

a lid configured to be positioned above the base and comprising a first operative region defined by a first recessed curved wall surface having a bounded perimeter defined by a first longitudinal wall, a second longitudinal wall, an upper ledge, and a lower ledge, the first operative region positioned at a first side of the lid, and a second operative region defined by a recessed face, the recessed face being substantially planar, the second operative region positioned on a side of the lid opposite the first operative region, wherein the lid is configured to be openable by pressing the first operative region in a first direction; and a hinge connecting the lid to the base;

wherein the shoulder is positioned below the first operative region, and wherein the frusto-conical lower portion of the nozzle has a first end connected to the shoulder at an area positioned below the first operative region and the first recessed curved wall surface, wherein, in the area where the first end of the frusto-conical lower portion of the nozzle is connected to the shoulder, the shoulder is substantially flat and parallel to the top of the lid, and wherein the shoulder comprises a cylindrical perimeter wall that has an outer diameter less than a diameter of an upper rim of the base, and the shoulder extends above the upper rim of the base.

15. The cap according to claim 14, wherein the second operative region comprises a ledge at a base of the second operative region.

16. The cap according to claim 15, wherein the hinge extends between and attaches the lid to the base.

17. The cap according to claim 16, wherein the hinge connects at a first end adjacent the ledge, and connects at a second end to the base.

18. The cap according to claim 14, wherein the first recessed curved wall surface curves away from the second operative region.

19. The cap according to claim 14, wherein the shoulder is substantially flat.

20. A cap comprising:

a base comprising a portion configured to attach to and surround an opening of a bottle, wherein the base further comprises a shoulder formed at an upper end of the base, and a nozzle extends from the shoulder, wherein the nozzle has a frusto-conical lower portion, the base having an upper rim;

a lid configured to be positioned above the base, the lid having a lower rim, the lid including:

a first operative region defined by a first recessed curved wall surface having a bounded perimeter defined by a first longitudinal wall, a second longitudinal wall, an upper ledge, and a lower ledge, the first operative region positioned at a first side of the lid, wherein the lid is configured to be openable by pressing the first operative region in a first direction; and a hinge, the hinge extending between the lid and the base and attaching the lid to the base, a first end of the hinge connected to the lid and a second end of the hinge connected to the base;

wherein, when the cap is in a closed position, the lower rim of the lid is configured to contact the upper rim of the base at a contact point, and wherein the shoulder is positioned below the first operative region and above the contact point, wherein the frusto-conical lower portion of the nozzle has a first end connected to the shoulder, and wherein, in an area where the first end of the frusto-conical lower portion of the nozzle is connected to the shoulder, the shoulder is substantially flat and parallel to the top of the lid.

21. The cap of claim 20, wherein the shoulder comprises a cylindrical perimeter wall that has a diameter less than a diameter of the upper rim of the base, and the shoulder extends above the upper rim of the base.

* * * * *